United States Patent [19]

Fosdick, Jr. et al.

[11] Patent Number: 4,612,986

[45] Date of Patent: Sep. 23, 1986

[54] WELL CLEANING APPARATUS AND TREATING METHOD

[76] Inventors: Frank D. Fosdick, Jr., 1685 Skyway St., Paradise, Calif. 95916; Jerald L. Browder, Rt. 1, Box 102, Maricopa, Calif. 93252

[21] Appl. No.: 616,578

[22] Filed: Jun. 4, 1984

[51] Int. Cl.[4] ..... E21B 37/02

[52] U.S. Cl. ..... 166/171; 166/170; 166/311; 166/312; 15/104.2

[58] Field of Search ..... 166/170, 171, 173, 176, 166/113, 311, 312; 15/104.16, 104.2

[56] References Cited

U.S. PATENT DOCUMENTS

| | | | |
|---|---|---|---|
| 1,342,618 | 6/1920 | Bashara | 15/104.16 X |
| 2,072,110 | 3/1937 | Jennings | 15/104.2 X |
| 2,215,514 | 9/1940 | MacGregor | 166/170 |
| 2,628,682 | 2/1953 | Wright | 166/241 X |
| 2,717,650 | 9/1955 | Hall, Sr. | 15/104.16 X |
| 3,176,772 | 4/1965 | MacGregor | 166/173 |
| 3,310,113 | 3/1969 | Maness | 15/104.2 X |
| 3,314,095 | 4/1967 | Prange | 15/104.2 |
| 3,390,725 | 7/1968 | Alexander, Jr. | 166/173 X |
| 3,561,534 | 2/1971 | Dendy | 166/311 |
| 3,827,492 | 8/1974 | Hammon et al. | 15/104.2 X |
| 4,159,742 | 7/1979 | Alexander, Jr. | 166/173 |
| 4,501,322 | 2/1985 | Martin | 166/173 |

*Primary Examiner*—George A. Suchfield
*Attorney, Agent, or Firm*—John J. Posta, Jr.

[57] ABSTRACT

A well cleaning apparatus and method of treating a well includes a generally tubular implement which has a first section with adjustable, radially extending cables, and a second section with cable loops extending outward, a bottom cone-shaped plug and a top plug. The first section cables can be anchored by rotating or sliding a crimping tube therein, or by molten material poured therein. The second section cable length can be adjusted by a sliding base bracket. The first section chops up scale, sludge and tar while the second section cables sweep them away. The method includes these steps, as well as steaming the casing at high pressure and low water volume to aid cleaning, and stimulate formation flow without creating sand bailing problems. The apparatus can be attached to the bottom of a well pump, with several first sections spaced along the length of the work string of the pump to enable cleaning of the entire well casing by a limited upward and downward movement of the entire assembly. The first sections also serve as centralizers of the work string. Cleaning compounds can be mixed with the cleaning water.

27 Claims, 8 Drawing Figures

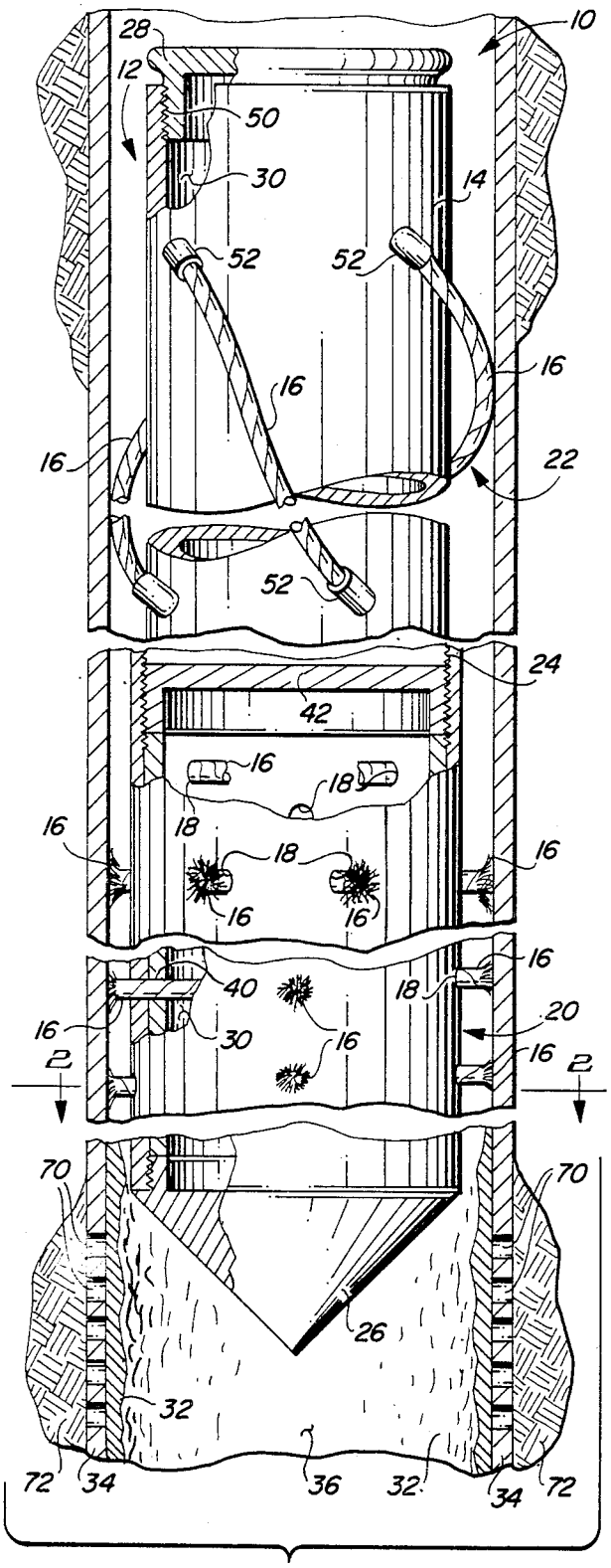
FIG. 1
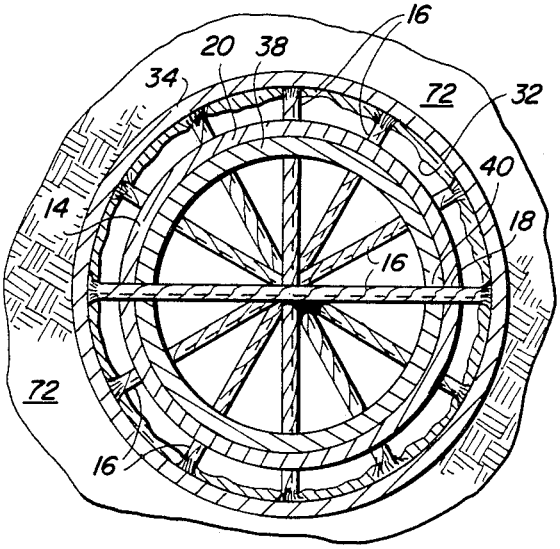
FIG. 2
FIG. 3
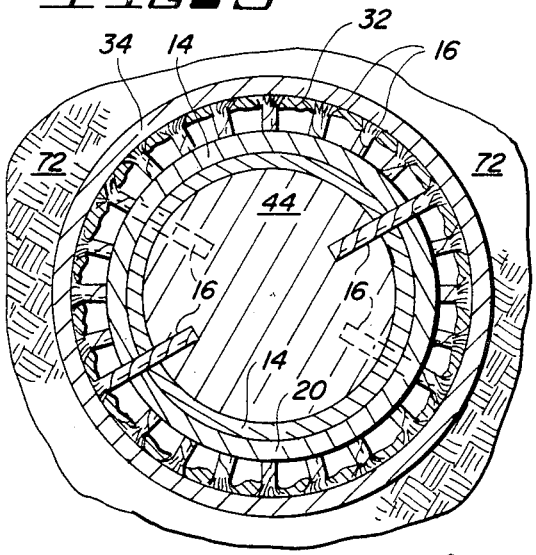
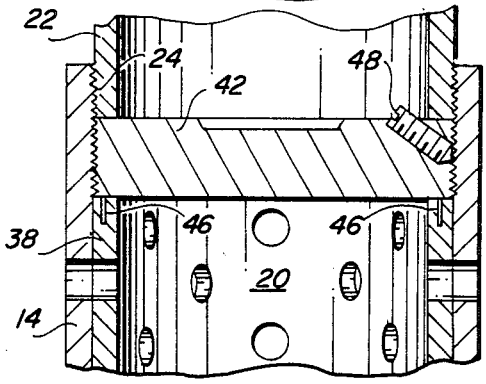
FIG. 4

WELL CLEANING APPARATUS AND TREATING METHOD

BACKGROUND OF THE INVENTION

1. FIELD OF THE INVENTION

The present invention generally relates to wells and, more particularly, to an improved method and apparatus for cleaning and treating wells.

2. PRIOR ART

Various types of apparatus and methods have been used to clean and treat wells, such as oil and gas wells and the like. In many instances scale, sludge and tar must be periodically removed from the interior of the well casing before and during production to prevent plugging and restriction of the perforations and well flow. Such methods and apparatus generally are expensive and utilize components which periodically have to be replaced at substantial cost. Moreover, many such cleaning methods and apparatus are not very efficient and are ill-suited for other forms of well treatments such as formation flow stimulation.

Other cleaning methods utilize specialized equipment employing high pressure, high volume (flow rate) steam treating techniques and the like which involve undue agitation of the soil and sand around the casing perforations, thereby substantially increasing the necessity for sand bailing; that is, the removal of sand newly and excessively loosened in the formation by the treatment, which sand enters the casing with the oil.

Most present secondary recovery systems employ pumps located within the well casing to pump oil to the surface. With time, the perforations in the casing become clogged with tar, scale, etc., as does the inside of the well casing. Present practice involves periodically removing the entire pump assembly, locating a cleaning tool within the casing to scrub the interior, and re-inserting the pump assembly within the casing. This is a long and costly process.

Accordingly, there is a need for a simplified method and apparatus capable of inexpensively, rapidly and efficiently cleaning a well and of also stimulating formation oil flow without increasing the risk of causing large intrusions of newly loosened formation sand and tar into the well.

SUMMARY OF THE INVENTION

The improved apparatus and method of the present invention satisfy all the foregoing needs. The apparatus and method are substantially as set forth in the Abstract. Thus, the apparatus is capable of being used, in accordance with the method, to rapidly, efficiently and thoroughly clean a well to remove scale, sludge and tar and to pass them out of the well as a suspension in the fluid, without excessively loosening formation sand and necessitating undue sand baling. The apparatus and method can also be used to clean the well without requiring the use of steam or air.

The apparatus comprises a hollow tubular implement which is adapted to travel up and down the interior of the well casing. The implement includes a pair of sections, each of which sections could be used alone, if desired. The two sections are secured together, one above the other, and are characterized by including inexpensive, easily replaceable cable such as scrap cable, the lower section employing the cable radially to collectively resemble a bottle brush and to initially break up and chop through the scale, sludge and tar.

The vertical, to and fro movement of the implement, turns the tool into a digester which causes dislodged particles to be broken down into finer particles small enough to be removed from the well as a suspension in the pumped oil. The other section employs usually three or more long whip-like flexible cables secured to the exterior thereof in a diagonal overlapping staggered configuration to sweep away the remaining scale, sludge and tar from the well casing interiors. Components in the two sections are adapted to lock the cables in place and adjust their effective length to fit various well casings and well conditions. The implement can also include a cone-shaped bottom plug and a removable top plug.

The first and/or second section can have steam, water and/or air holes and can be connected to a high pressure, low volume input line so that the casing and perforations can be cleaned further, with the scale, sludge and tar being particularized into a suspension which is carried by the oil outside the well. If desired, a solvent or other cleaning fluid can be dissolved in the water or steam to provide further cleaning. Since low volume is used, less solvent need be employed.

A lift rod can also be included to move the implement up and down the well casing interior to accomplish the cleaning operation. The apparatus is inexpensive and simple to use, make, repair and replace.

The method of the present invention involves the use of the improved apparatus in the initial cleaning and dislodging of scale, sludge and tar from the casing interior, followed by the application of a controlled volume and flow rate of high pressure steam, water and/or air, with or without solvents to dissolve or place in suspension dislodged material without excessively loosening formation sand.

The use of discrete upper sections of the implement at spaced intervals along the length of the pump work string serves the dual purpose of cleaning the casing while also serving as a centralizer to keep the work string spaced from the wall of the casing.

The invention contemplates attaching the upper and lower sections of the cleaning implement to the bottom of presently used pumping assemblies, and securing upper sections thereof at spaced intervals (about 200 ft.) along the work string of the pump. These upper sections act as centralizers to space the work string from the well casing. This assembly allows the cleaning of the well casing interior and perforation by movement of the cleaning implements and pump assenbly as a unit, up and down only about 200 ft. to effect cleaning, eliminating the need to remove the entire pump assembly from the well, cleaning the casing, to re-inserting the pump assembly.

Various other features of the present invention are set forth in the following detailed description and accompanying drawings.

DRAWINGS

FIG. 1 is a schematic, fragmentary, side elevation, partly in section and partly broken away, illustrating a first preferred embodiment of the improved well cleaning apparatus of the present invention;

FIG. 2 is a schematic cross-section, taken along the line 2—2 of FIG. 1;

FIG. 3 is a schematic cross-section of an alternate more of securing the cables of the apparatus of the present invention in place;

FIG. 4 is a schematic fragmentary cross-section of a modified manner of securing the sections of the apparatus of FIG. 1 together and of crimping the cables of the lower section of the apparatus of FIG. 1;

DETAILED DESCRIPTION

FIGS. 1 and 2

Figure 5:
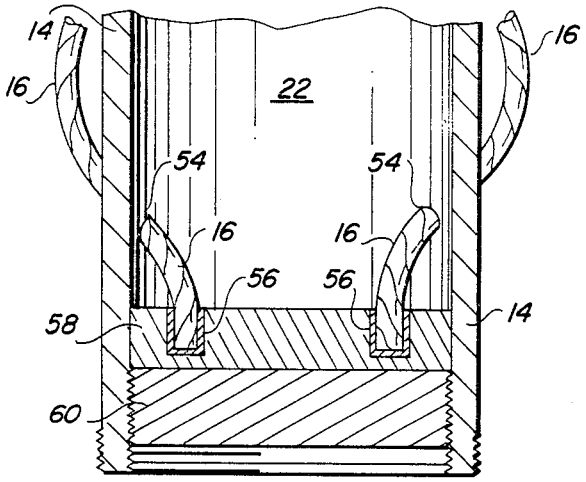
FIG. 5 is a schematic fragmentary crosssection of the lower end of the upper section of the apparatus of FIG. 1.

Now referring to FIG. 1 of the accompanying drawings, a preferred embodiment of the improved well cleaning apparatus of the present invention is schematically illustrated therein. Thus, apparatus 10 is shown which comprises an elongated, hollow implement 12 having a generally tubular sidewall 14, of steel or the like, and a plurality of flexible new or used wire cables 16 of steel or the like extending out of a plurality of spaced openings 18 in sidewall 14.

Implement 12 comprises a lower or first section 20 and an upper or second section 22 threaded thereto, as at 24, to act as a single unit therewith. Implement 12 can also include a bottom conical plug 26 threaded to sidewall 14 and a top plug 28 also threaded to sidewall 14, as shown in FIG. 1. Top plug 28 in the embodiment of FIG. 1 is not needed, but is desirable, in order to keep the interior 30 of implement 12 free of scale, sludge and debris 32.

Lower section 20 has spaced openings 18 disposed along the length of section 20 in a suitable staggered array, preferably as pairs of opposed openings 18, so that each cable 16 in section 20 can span section 20 (FIG. 2), with its opposite ends extending radially outwardly of sidewall 14 a controlled distance. The resulting array of cable ends forms a bottle brush configuration for effective cleaning of casing 34, to free it of scale, sludge and tar 32 deposited in the interior 36 thereof.

Cables 16 in section 20 can be releasably locked in place and adjusted in length of extension out of section 20 by means of a hollow, elongated tubular slide 38 slideably disposed in interior 30 of section 20 and having openings 40 therein fully alignable with openings 18 and through which cables 16 pass. When slide 38 is displaced longitudinally relative to sidewall 14 in section 20, while cables 16 extend therethrough and through sidewall 14, as by screwing down cap 42 which rests on the top of slide 38, cap 42 being threaded to sidewall 14 (FIG. 1), cables 16 are crimped and held in place in section 20. The greater the displacement the greater the shortening of the portion of cables 16 outside section 20. Thus, the length and effective stiffness of such cable portion is easily regulated to accommodate various diameters of well casing 34. Such crimping is easily removed by unscrewing cap 42, for example, when replacing worn out cables 16.

FIG. 3

FIG. 3 illustrates a second method of anchoring cables 16 in place in section 20. This can be accomplished by pouring molten potting material 44 into the interior 30 of section 20 to fill interior 30 and then allowing material 44 to harden. Material 44 could be any suitable material, preferably metal selected from the group consisting of aluminum, solder and mixtures thereof. It will be noted that in this instance cables 16 need not span section 20, but merely need to be long enough to be firmly embeddable in material 44.

FIG. 4

A third method of securing cables 16 in section 20 is schematically illustrated in FIG. 4. Thus, cap 42 in this instance is provided with pins 46 which join it to the top of slide 38 so that rotation of cap 42 automatically rotates slide 38 with it, again causing crimping and locking of cables 16 passing through aligned openings 18 and 40. A tight fit between cap 42 and sidewall 14 and/or set screws 48, or the like, extending through cap 42 into contact with sidewall 14 are required to assure that the crimping position achieved is maintained until it is desired to release cables 16 in section 20.

Section 20, with or without section 22 and/or plugs 26 and 28, can be used to clean scale, sludge and tar 32 from casing 34. Cables 16 of section 20 are adjusted to about contact casing 34. Vertical oscillation of section 20 in casing 34 cuts thru and dislodges material 32 wherever cables 16 of section 20 pass into contact therewith. Although section 20 can be rotated during the cleaning operation, this step is inconvenient to take at depth in a well. Therefore, it is preferred merely to vertically oscillate section 20 in the well and to rely on section 22 to complete the cleaning task by "shearing" off debris, scale, etc., extending inwardly from the well casing.

FIGS. 1 and 5

Section 22 is preferably releasably secured to the top of section 20, as by, for example, threaded portions 24 shown in FIG. 1 as previously described. Section 22 is hollow, tubular and elongated, as is section 20, and top plug 28 may be releasably secured in the upper end of section 22, as by threads 50. A plurality of spaced angled guide tubes 52, for example, 4-12 in number, are secured to and extend outwardly from the exterior surface of sidewall 14 in section 22.

In the embodiment of FIG. 1, three upper tubes 52 are provided, spaced apart about one third of the circumference of section 22, angled diagonally downwardly and securely holding the upper ends of cables 16 of section 22. There are also a matching three lower tubes 52 angled diagonally upwardly and circumferentially offset from upper tubes 52, so as to receive the lower portions of those cables 16. The lower ends of cables 16 of section 22 pass through openings 54 in sidewall 14 behind lower tubes 52 and are locked into receptacles 54 in a bracket 58 which slides longitudinally in the interior 30 of section 22 (FIG. 5).

The intermediate portion of each cable 16 of section 22 assumes a flexible, loose diagonally curved, loop-like configuration, and tubes 52 are aligned such that those cables 16 in section 22 are in what amounts to overlapping array; that is, they do not physically contact each other, but instead their curved paths fall under each other, so that the entire circumference of section 22 is an effective cleaning agent. As section 22 is vertically oscillated, scale, sludge and debris 32 left in casing 34 after passage of section 20 therethrough is thoroughly stripped away from all of the inner surface of casing 34.

In order to be able to adjust the length of the portion of each cable 16 on the exterior of section 22 and thus the area swept by such cables 16, a bottom plug 60 is threadably received in section 22 below bracket 58 (FIG. 5). Plug 60 can be rotated upwardly and downwardly therein, thus repositioning bracket 58, thereby controlling the length of the section 22 cables outside sidewall 14. This allows section 22 to be adapted for use in casing 34 of various internal diameters. Stops 61 above bracket 58 may limit the upward travel of bracket 58 so that the effective length of cables 16 outside section 22 can be controlled during cleaning. When section 22 is initially passed down casing 34, and also when it is removed from casing 34, preferably plug 60 is in the down position so that cables 16 are close to the exterior of section 22, to minimize resistance to such passage. Various means (not shown) can be used to rotate plug 60 from a remote location above the implement.

Figure 7:
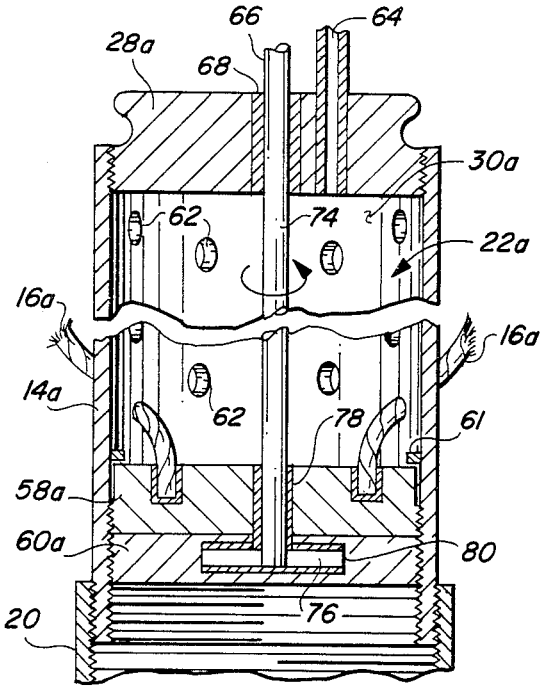
FIG. 7 is a schematic cross-section of the form of the upper section shown in FIG. 6 with a lift rod and steam line in place.
Figure 6:
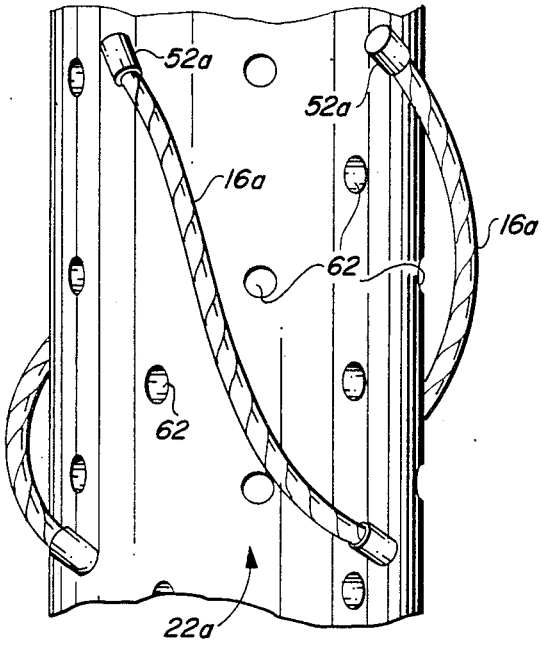
FIG. 6 is a schematic fragmentary side elevation of a modified form of the upper section of the apparatus of FIG. 1.

A modified version of the upper section 22 is shown in FIGS. 6 and 7. Thus, section 22*a* is shown. Components thereof similar to those of section 22 bear the same numerals but are succeeded by the letter "a". Section 22*a* is hollow and cylindrical with cables 16*a* and guide tubes 52*a*, bracket 58*a* and plug 60*a* and is identical in all respects to section 22 except that it includes a plurality of steam, water and/or air holes 62 extending through sidewall 14*a*, and an input line 64 and lift rod 66 running through top plug 28*a*. Plug 28*a* may be fitted with suitable gasketing 68 so that the fluid or gas medium passing into interior 30*a* of section 22*a* can only exit through openings 62. Such steam, water or air or other fluid can be contained with a suitable solvent or other cleaner, to dissolve and/or dislodge tar on the inside of the well casing and in and around perforations in the casing for subsequent removal thereof with the oil pumped or otherwise removed from the well.

In accordance with the present method, casing 34 is first cleaned by oscillating at least one of sections 20 and 22*a*, and preferably both such sections in casing 34 to dislodge scale, sludge and tar from the inside of casing 34. Thereafter, high pressure water, for example, about 1,000 psi to about 10,000 psi at 3,500 ft. is passed into section 22*a* through lines 64 and out holes 62, thereby cleaning the interior of the well casing without unduely agitating the soil and sand outside holes 70 at 72. The volume and flow rate of the water are kept relatively low; that is, high enough to thoroughly and rapidly perform the cleaning operation, but low enough to prevent excessive loosening of formation sand which would result in excessive sand intruding into casing 34 through holes 70 during production. Thus, for a normal casing water would normally be passed at a low flow rate of, for example, about 6 to about 20 g.p.m. through openings 62 to accomplish the cleaning operation.

Normally, the weight of apparatus 10 is such as to enable implement 12 to readily drop down through casing 34, cleaning it. In order to vertically oscillate implement 12 it is preferred to employ a lift rod 66. If the implement 12 is attached to the bottom of a pump assembly, the work string is used for oscillation rather than a separate lift rod 66. Thus, rod 66 has an elongated vertical shaft 74 and a flat narrow horizontal base plate 76. Shaft 74 is disposed through an opening 78 in bracket 58*a* and plate 76 is seated in a slot 80 in plug 60*a*. Thus, rod 66 can be rotated to rotate plug 60*a*, adjusting the position of bracket 58*a* connected and cables 16*a*. Alternatively, the bottom end of shaft 66 could merely be threaded into or welded to plug 60*a* (not shown) and plate 76 could be dispensed with.

In any event, upward urging on rod 66 lifts section 22*a* and the remainder of implement 12 while downward urging on rod 66 pushes implement 12 down in casing 34. Vertical oscillation of implement 12 can thus be easily achieved with rod 66.

FIG. 8

Figure 8:
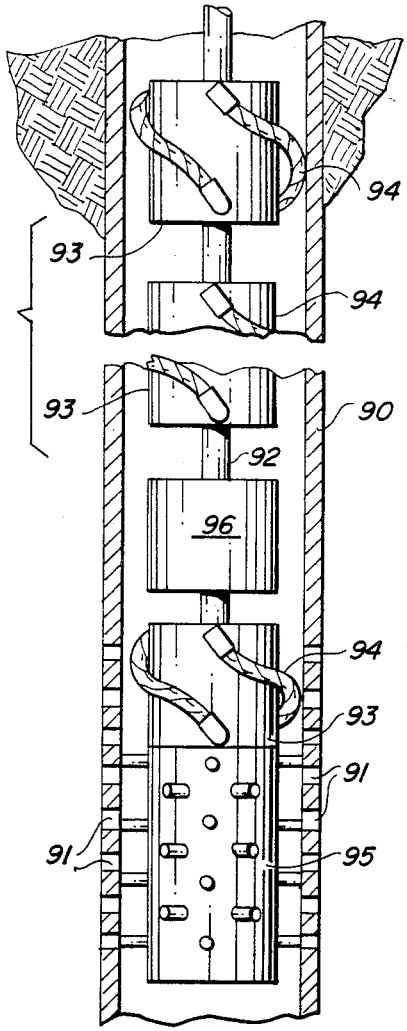
FIG. 8 is a schematic fragmentary, side elevation showing a further embodiment of the invention with the cleaning implements attached to a well pump assembly.

Another embodiment of the invention is shown in FIG. 8, wherein well casing 90 is provided having perforations 91 therein at lower end of casing 90. Pump assembly 96 is disposed within well casing 90, along with work string 92. Upper cleaning implement 93 which is the same as upper section 22 of FIG. 1 is secured to work string 92 at intervals along its length, thereby serving to centralize the work string 92 and keep it spaced from the inside walls of casing 90. An upper cleaning implement 93 is also connected to the lower end of pump assembly 96 while a lower cleaning implement 95, which is similar to lower section 20 of FIG. 1, is secured to the bottom of upper cleaning element 93. The entire pump assembly 96, work string 92, cleaning elements 93 and 94 are reciprocated inside well casing 90 to clean the inside surface thereof. This cleaning can be effected without first removing the work string 92 and pump assembly 96 from the well casing 90 as is now common in the industry, thereby resulting in a considerable saving of time and expense.

Implement 12 can be fabricated rapidly, inexpensively and durably of any suitable materials, such as steel pipe, discarded steel cable lengths, etc. It can be made in any suitable diameter and length and can be easily assembled and disassembled to replace the cables, etc. As the outer ends of cables 16 of section 20 fray, their cleaning action increases, since their surface area increases. Their stiffness can be regulated by their length. The sweeping action of cables 16 of section 22 can be regulated by adjusting their length. Other adjustments are also possible. The following specific examples further illustrate certain features of the present invention:

EXAMPLE I

A 5 inch diameter (ID) casing 34 for an oil well is cleaned using the apparatus of the present invention, employing sections 20 and 22*a* with plugs 28*a*, rod 66, steam line 64 and water, air or steam holes 62 of FIGS. 1 and 7. Section 20 has an O.D. of 3 inches, a length of 7 ft., has 36 openings 18, with cables 16 thereof of each about $5\frac{1}{4}$ inches in length, and 9/16 inch in diameter, each end thereof sticking out about 1 inch from section 20. Cables 16 in section 20 are crimped in place by threaded cap 42 pushing down on inner tube slide 38. Cables 16 of section 20 are of sufficient length to about span the I.D. of casing 34. Section 22*a* has an O.D. of $2\frac{1}{2}$ inches, a length of 18 inches, has three cables, each of about 21 inches in length exposed outside section 22*a*, and has 20 holes 62 about $\frac{1}{2}$ inch diameter spaced about 1 inch apart. Lift rod 66 is seated in plug 60*a* and is used to adjust the position of plug 60*a* and bracket 58*a* and to vertically oscillate the implement (connected sections 20, 22*a*, etc.) approximately 160 feet per stroke for a total of about 6 times until substantially all scale, sludge and tar is dislodged from the interior surfaces of casing 34.

Steam is then passed into section 22*a* through line 64 and out holes 62, while section 22*a* is positioned adjacent casing holes 70, thus driving dislodged material 32 from casing holes 70. Casing holes 70 are also scoured by this procedure. The cleaning operation takes a total time of 15 minutes and leaves casing 34 thoroughly clean.

EXAMPLE II

Various modifications, changes, alterations and additions can be made in the improved apparatus of the present invention, its components and their parameters, and in the present method, its steps and parameters. All such modifications, changes, alterations and additions as are within the scope of the appended claims form part of the present invention.

What is claimed is:

1. An improved well cleaning apparatus, said apparatus comprising, in combination:

(a) an elongated implement having a sidewall; and, (b) a plurality of flexible adjustable wire cable means extending out of a plurality of spaced openings in said sidewall of said implement for releasable engagement with the interior surface of a well casing for removal of deposited scale, sludge, clay, sand, tar, etc., therefrom, (c) wherein said apparatus includes a first section having a plurality of said cables extending generally outwardly from said implement, and a second section disposed next to said first section and having a plurality of said cables extending outwardly of said implement and disposed in a flexible curved loop-like configuration outside of said sidewall, (d) wherein said implement includes a closed generally conical bottom plug secured to the bottom of said sidewall.

2. The improved apparatus of claim 1 wherein each said cable of said first section spans opposed openings in said implement.

3. An improved well cleaning apparatus, said apparatus comprising, in combination:

(a) an elongated implement having a sidewall; and, (b) a plurality of flexible adjustable wire cable means extending out of a plurality of spaced openings in said sidewall of said implement for releasable engagement with the interior surface of a well casing for removal of deposited scale, sludge, clay, sand, tar, etc., therefrom, (c) wherein said apparatus includes a first section having a plurality of said cables extending generally outwardly from said implement, and a second section disposed next to said first section and having a plurality of said cables extending outwardly of said implement and disposed in a flexible curved loop-like configuration outside of said sidewall, (d) wherein said implement includes a removable top plug secured to the top of said sidewall.

4. An improved well cleaning apparatus, said apparatus comprising, in combination:

(a) an elongated implement having a sidewall; and, (b) a plurality of flexible adjustable wire cable means extending out of a plurality of spaced openings in said sidewall of said implement for releasable engagement with the interior surface of a well casing for removal of deposited scale, sludge, clay, sand, tar, etc., therefrom, (c) wherein said apparatus includes a first section having a plurality of said cables extending generally outwardly from said implement, and a second section disposed next to said first section and having a plurality of said cables extending outwardly of said implement and disposed in a flexible curved loop-like configuration outside of said sidewall, (d) wherein said cables of said first section are secured in place to said implement by securing means, (e) wherein said securing means comprises a hollow elongated tubular slide slideably disposed in said first section and having openings alignable with those of said implement sidewall, and wherein said cables extend through said slide openings, and crimping means for misaligning said slide openings relative to said implement openings to crimp said cables therebetween.

5. The improved apparatus of claim 4 wherein said crimping means comprises a cap seated on one end of said slide and threadably engaging the interior of said implement sidewall to adjustably force said slide longitudinally relative to said implement sidewall to effect said cable crimping.

6. The improved apparatus of claim 4 wherein said crimping means comprises a cap seated on one end of said slide and keyed thereto, said cap threadably engaging the interior of said implement sidewall, whereby rotation of said cap rotates said slide to effect said cable crimping.

7. The improved apparatus of claim 4 wherein said first section openings and cables are disposed in a staggered array and wherein the length of said cables extending out of said first section openings is controllable by the extent of crimping effected by crimping means.

8. An improved well cleaning apparatus, said apparatus comprising, in combination:

(a) an elongated implement having a sidewall; and, (b) a plurality of flexible adjustable wire cable means extending out of a plurality of spaced openings in said sidewall of said implement for releasable engagement with the interior surface of a well casing for removal of deposited scale, sludge, clay, sand, tar, etc., therefrom, (c) wherein said apparatus includes a first section having a plurality of said cables extending generally outwardly from said implement, and a second section disposed next to said first section and having a plurality of said cables extending outwardly of said implement and disposed in a flexible curved loop-like configuration outside of said sidewall, (d) wherein said cables of said first section are secured in place to said implement by securing means, (e) wherein said securing means comprises potting material poured molten into the hollow interior of said first section of said implement to substantially fill the same and lock said first section cables in place therein.

9. The improved apparatus of claim 8 wherein said potting material comprises material selected from the group consisting of aluminum, solder and mixtures thereof.

10. An improved well cleaning apparatus, said apparatus comprising, in combination:

(a) an elongated implement having a sidewall; and, (b) a pluralty of flexible adjustable wire cable means extending out of a plurality of spaced openings in said sidewall of said implement for releasable engagement with the interior surface of a well casing for removal of deposited scale, sludge, clay, sand, tar, etc., therefrom, (c) wherein said apparatus includes a first section having a plurality of said cables extending generally outwardly from said implement, and a second section disposed next to said first section and having a plurality of said cables extending outwardly of said implement and disposed in a flexible curved loop-like configuration outside of said sidewall, (d) wherein said sidewall of said second section includes a plurality of spaced angled aligned guide tubes connected to the exterior of said sidewall and into which said cables extend.

11. The improved apparatus of claim 10 wherein certain of said tube guides receive and secure the upper ends of said cables, while others of said tube guides are disposed over said openings in said second section sidewall and permit passage of said cables into the interior of said second section.

12. The improved apparatus of claim 11 wherein the lower ends of said cables in said second section are secured in receptacles in a longitudinally slideable bracket in said second section, the longitudinal position of said bracket relative to said second section sidewall determining the effective length of said cables outside said second section.

13. The improved apparatus of claim 12 wherein said second section includes means for sliding said bracket longitudinally relative to said implement sidewall.

14. The improved apparatus of claim 13 wherein said bracket sliding means comprises a bottom plug threaded into the bottom of said second section below said bracket and rotatable to travel longitudinally in said second section.

15. The improved apparatus of claim 14 wherein said second section includes an elongated lifting rod extending down through an opening in said bracket to said second section bottom plug and including a base engageable with said bottom lower plug to lift and lower said implement in a well casing.

16. The improved apparatus of claim 15 wherein said second section includes bracket stop means to restrict the extent of longitudinal travel of said bracket in said implement and wherein said cables are disposed in a diagnonal overlapping array.

17. The improved apparatus of claim 10 wherein the sidewall of said second section includes a plurality of perforations adapted to permit passage of steam and other fluids out of said second section, and wherein said second section is fitted with a fluid supply line.

18. An improved well cleaning apparatus, said apparatus comprising:

(a) a elongated hollow tubular implement having a plurality of wire cable ends extending generally radially outwardly of said implement a controlled distance through openings in said implement sidewall, said cables being secured in place by securing means to form a bottle brush configuration, (b) wherein said securing means comprises a hollow elongated tubular slide slideably disposed in said implement and having openings alignable with those of said implement sidewall, and wherein said cables extend through said slide and sidewall openings, and crimping means for misaligning said slide openings relative to said sidewall openings to crimp said cables therebetween, (c) wherein said crimping means comprises a cap seated on one end of said slide and threadably engaging the interior of said implement sidewall to adjustably force said slide longitudinally relative to said implement sidewall to effect said cable crimping.

19. An improved well cleaning apparatus, said apparatus comprising:

(a) an elongated hollow tubular implement having a plurality of wire cable ends extending generally radially outwardly of said implement a controlled distance through openings in said implement sidewall, said cables being secured in place by securing means to form a bottle brush configuration, (b) wherein said securing means comprises a hollow elongated tubular slide slideably disposed in said implement and having openings alignable with those of said implement sidewall, and wherein said cables extend through said slide and sidewall openings, and crimping means for misaligning said slide openings relative to said sidewall openings to crimp said cables therebetween.

(c) wherein said crimping means comprises a cap seated on one end of said slide and connected thereto, said cap threadably engaging the interior of said implement sidewall, whereby rotation of said cap effects rotation of said slide to cause said cable crimping.

20. An improved well cleaning apparatus, said apparatus comprising:

(a) an elongated hollow tubular implement having a plurality of wire cables ends extending generally radially outwardly of said implement a controlled distance through openings in said implement sidewall, said cables being secured in place by securing means to form a bottle brush configuration, (b) wherein said securing means comprises potting material poured molten into the hollow interior of said implement to lock, when solidified, said cables in place therein.

21. The improved apparatus of claim 20 wherein said potting material comprises material selected from the group consisting of aluminum, solder and mixtures thereof.

22. An improved well cleaning apparatus, said apparatus comprising:

(a) an elongated, hollow and tubular implement having a sidewall, and the intermediate portions of a plurality of cables extending outwardly of the sidewall thereof and disposed in a flexible, curved, loop-like configuration outside of said sidewall, (b) wherein the exterior of said implement includes a plurality of spaced angled aligned guide tubes into which said cables extend, and (c) wherein certain of said tube guide receive and secure the upper ends of said cables, while others of said tube guide are disposed over openings in said sidewall and permit passage of said cables into the interior of said implement, (d) wherein the lower ends of said cables in said implement are secured in receptacles in a longitudinally slideable bracket in said implement, the longitudinal position of said bracket relative to said implement sidewall determining the length of said cables outside said implement.

23. The improved apparatus of claim 22 wherein said implement includes means for sliding said bracket longitudinally relative to said implement sidewall.

24. The improved apparatus of claim 23 wherein said bracket sliding means comprises a bottom plug threaded into the bottom of said sidewall below said bracket and rotatable to travel longitudinally in said implement.

25. The improved apparatus of claim 24 wherein said implement includes an elongated lifting rod extending down through an opening in said bracket and into connection with said bottom plug, whereby vertical oscillation of said rod vertically oscillates said implement.

26. The improved apparatus of claim 25 wherein said implement includes bracket stop means to restrict the extent of longitudinal travel of said bracket in said implement and wherein said cables are positioned diagonally and in staggered array.

27. The improved apparatus of claim 26 wherein sidewall of said implement includes a plurality of perforations adapted to permit passage of steam and other fluids out of said implement.

* * * * *